US009502790B2

(12) United States Patent
Kollmann et al.

(10) Patent No.: US 9,502,790 B2
(45) Date of Patent: Nov. 22, 2016

(54) SPRING CLAMP CONTACT AND CONNECTING TERMINAL FOR ELECTRICAL CONDUCTORS

(71) Applicant: WAGO Verwaltungsgesellschaft mbH, Minden (DE)

(72) Inventors: Hans-Josef Kollmann, Minden (DE); Wolfgang Gerberding, Oldendorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/767,719

(22) PCT Filed: Feb. 12, 2014

(86) PCT No.: PCT/EP2014/052719

§ 371 (c)(1),
(2) Date: Aug. 13, 2015

(87) PCT Pub. No.: WO2014/124961

PCT Pub. Date: Aug. 21, 2014

(65) Prior Publication Data

US 2015/0372402 A1 Dec. 24, 2015

(30) Foreign Application Priority Data

Feb. 13, 2013 (DE) ..... 20 2013 100 635 U

(51) Int. Cl.
*H01R 4/48* (2006.01)

(52) U.S. Cl.
CPC ..... *H01R 4/4818* (2013.01); *H01R 4/4836* (2013.01)

(58) Field of Classification Search
CPC .. H01R 4/4809; H01R 4/4881; H01R 43/16; H01R 13/187; H01R 4/48; H01R 4/52; G01R 1/06722
USPC ..... 439/816
See application file for complete search history.

(56) References Cited

U.S. PATENT DOCUMENTS 3,528,050 A * 9/1970 Hindenburg ..... H01R 4/4809 439/535
5,046,965 A * 9/1991 Neese ..... A61B 5/0448 439/372

(Continued)

FOREIGN PATENT DOCUMENTS

CN 102832465 A 12/2012
DE 600 00 150 T2 12/2002

(Continued)

OTHER PUBLICATIONS

International Search Report and translation thereof, for corresponding International application No. PCT/EP2014/052719 dated May 12, 2014.

(Continued)

*Primary Examiner* — Abdullah Riyami
*Assistant Examiner* — Vladimir Imas
(74) *Attorney, Agent, or Firm* — Renner, Otto, Boisselle & Sklar, LLP

(57) ABSTRACT

A resilient clamping contact for contacting electrical conductors, said resilient clamping contact having a current rail and having at least two resilient clamping elements that each have a contacting limb, a resilient bend that adjoins the contacting limb and a clamping limb that adjoins the resilient bend and comprises a clamping section at the free end, and having frame parts that extend away from the current rail and have in each case two lateral connecting pieces that are spaced apart from one another and transverse connecting pieces that connect the lateral connecting pieces one to the other, and a conductor feedthrough opening that is formed by the lateral connecting pieces and the transverse connecting pieces. A resilient clamping element is fastened to the current rail by means of the contact of the contacting limb of the resilient clamping element and/or a retaining element of the current rail to a transverse connecting piece in such a manner that the clamping section acts in the direction of the current rail under the influence of the resilient force of the resilient clamping element. The at least two frame parts for the at least two resilient clamping elements are arranged spaced apart from one another with an intermediate space between two spaced apart lateral connecting pieces of adjacent frame parts.

9 Claims, 5 Drawing Sheets

(56) References Cited

U.S. PATENT DOCUMENTS

Figure 1:
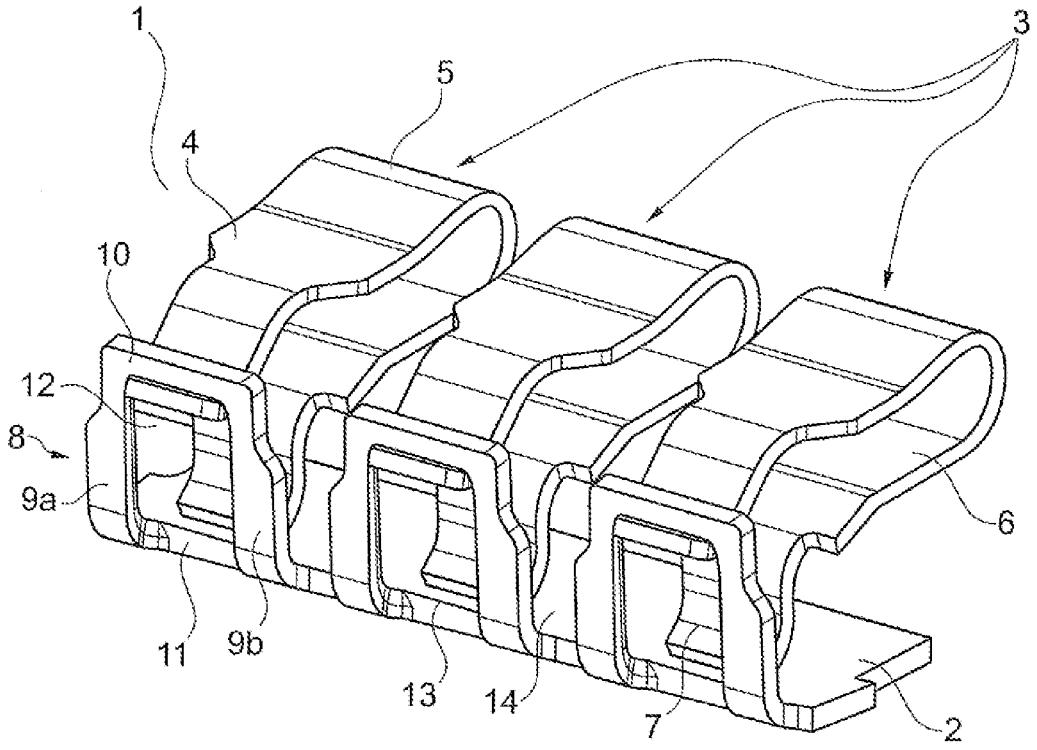

| | | | | |
|---|---|---|---|---|
| 5,575,695 | A * | 11/1996 | De Bernardis | H01R 4/4818 439/441 |
| 5,975,940 | A * | 11/1999 | Hartmann | H01R 4/4818 439/441 |
| 6,280,233 | B1 * | 8/2001 | Beege | H01R 4/4827 439/441 |
| 6,786,779 | B2 * | 9/2004 | Feldmeier | H01R 13/506 439/729 |
| 6,814,608 | B2 * | 11/2004 | Kollmann | H01R 4/4827 439/441 |
| 6,893,286 | B2 * | 5/2005 | Drewes | H01R 31/08 439/441 |
| 7,150,661 | B2 * | 12/2006 | Cisey | H01R 4/48 439/857 |
| 7,238,043 | B2 * | 7/2007 | Reibke | H01R 4/4827 439/441 |
| 7,244,140 | B2 * | 7/2007 | Edenharter | H01R 4/4818 439/439 |
| 7,618,279 | B1 * | 11/2009 | Osborn, Jr. | H01R 4/4818 439/441 |
| 7,896,686 | B2 * | 3/2011 | Hoppe | H01R 4/4827 439/441 |
| 8,033,870 | B2 * | 10/2011 | Xie | H01R 12/57 439/660 |
| 8,192,226 | B2 * | 6/2012 | Keswani | H01R 4/4818 439/441 |
| 8,491,327 | B2 * | 7/2013 | Hartmann | H01R 31/085 439/441 |
| 8,632,355 | B2 * | 1/2014 | Hartmann | H01R 4/4845 439/411 |
| 8,771,027 | B2 * | 7/2014 | Zhang | H01R 4/4809 439/835 |
| 8,932,075 | B2 * | 1/2015 | Reibke | H01R 4/4818 439/441 |
| 2004/0077210 | A1 * | 4/2004 | Kollmann | H01R 4/4827 439/441 |
| 2005/0042912 | A1 | 2/2005 | Drewes et al. | |
| 2011/0073364 | A1 * | 3/2011 | Reibke | H01R 4/4827 174/652 |
| 2012/0149231 | A1 * | 6/2012 | Keswani | H01R 4/4818 439/355 |
| 2013/0029537 | A1 * | 1/2013 | Reibke | H01R 4/4818 439/708 |
| 2015/0349437 | A1 * | 12/2015 | Kollmann | H01R 4/4836 439/729 |

FOREIGN PATENT DOCUMENTS

| | | | |
|---|---|---|---|
| DE | 196 54 611 | B4 | 9/2004 |
| DE | 203 13 855 | U1 | 2/2005 |
| DE | 10 2008 028 575 | A1 | 12/2008 |
| DE | 10 2009 004 513 | A1 | 7/2010 |
| DE | 102 37 701 | B4 | 9/2010 |
| DE | 10 2007 017 593 | B4 | 7/2011 |
| DE | 10 2010 024 809 | A1 | 12/2011 |
| DE | 10 2010 025 930 | A1 | 1/2012 |
| DE | 20 2011 104 318 | U1 | 10/2012 |
| DE | 10 2011 054 425 | A1 | 4/2013 |
| DE | 10 2012 005 465 | B3 | 5/2013 |
| DE | 10 2011 056 410 | A1 | 6/2013 |
| EP | 1515397 | A1 | 3/2005 |

OTHER PUBLICATIONS

International Preliminary Report on Patentability for corresponding International application No. PCT/EP2014/052719 dated Aug. 27, 2015.

* cited by examiner

SPRING CLAMP CONTACT AND CONNECTING TERMINAL FOR ELECTRICAL CONDUCTORS

This application is a national phase of International Application No. PCT/EP2014/052719 filed Feb. 12, 2014.

FIELD OF THE INVENTION

The invention relates to a resilient clamping contact for contacting electrical conductors, said resilient clamping contact having a current rail and having at least two resilient clamping elements that each have a contacting limb, a resilient bend that adjoins the contacting limb and a clamping limb that adjoins the resilient bend and comprises a clamping section at the free end, and having frame parts that extend away from the current rail and have in each case two lateral connecting pieces that are spaced apart from one another and a transverse connecting piece that connects the lateral connecting pieces one to the other, wherein a conductor feedthrough opening is formed by means of the lateral connecting pieces and the transverse connecting piece, the contacting limb of an allocated resilient clamping element lies against the transverse connecting piece and the clamping section acts in the direction of the current rail under the influence of the resilient force of the resilient clamping element.

The invention further relates to a connecting clamp for electrical conductors having a housing that is embodied from an insulating material and having at least one resilient clamping contact of this type.

BACKGROUND

Resilient clamping contacts of this type are used in connecting clamps in particular in socket terminals for connecting multiple electrical conductors in an electrically conductive manner, in circuit board plug-in connectors, any other plug-in connectors and series terminals or any other electrical devices.

DE 10 2007 017 593 B4 discloses a connecting clamp that comprises a resilient steel plate and two leaf spring tongues are cut out of the said resilient steel plate in a mirror-symmetrical manner with respect to the middle plane. A current rail rod lies in the middle plane on the piece of resilient steel plate.

Furthermore, DE 102 37 701 B4 discloses a lever-actuated connecting clamp, wherein a cage clamp spring lies with its contacting limb on a current rail piece that protrudes through a conductor feedthrough opening of the cage clamp spring. The lever acts upon an actuating section of the cage clamp spring from above, wherein the clamping section that comprises the conductor feedthrough opening is bent away from the actuating section in a transverse manner with respect to the current rail piece.

Furthermore, it is known from DE 196 54 611 B4 to latch a leaf spring, which is bent in a U-shaped manner, into a conductor feedthrough opening of a current rail piece. The current rail piece comprises for this purpose a retaining limb and a contacting limb that together form a corner angle in such a manner that the retaining limb, which is used to retain the leaf spring, is arranged with its back face in a transverse manner with respect to the direction in which the conductor is inserted and comprises a throughgoing opening for guiding through the electrical conductor, and that the contacting limb directly adjoins the vertex of the corner angle of the retaining angle and extends therefrom in the direction in which the conductor is inserted.

DE 10 2010 024 809 A1 discloses a lever-actuated connecting clamp having a housing, which is embodied from an insulating material, and a resilient clamping unit having a resilient clamping element and a current rail section. The resilient clamping element comprises a contacting section that is latched in a bracket that protrudes away from the current rail section and comprises a conductor feedthrough opening. Furthermore, the resilient clamping element comprises a clamping section, which is shaped so as to clamp an electrical conductor against the current rail section, and an actuating section that protrudes therefrom and extends away from the direction of the resilient force that is exerted by the resilient clamping element on the clamping section and in order to be influenced by an actuating element is arranged in such a manner that the actuating element can be brought into engagement by means of the actuating section so as to exert a tractive force on the actuating section when displacing the actuating element against the resilient force in order to open the resilient clamping element.

On this basis, the object of the present invention is to provide an improved resilient clamping contact for contacting electrical conductors and also to provide an improved connecting clamp for electrical conductors.

The object is achieved by means of the resilient clamping contact having the features of claim 1 and also by means of the connecting clamp having the features of claim 7.

SUMMARY OF THE INVENTION

It is proposed for a resilient clamping contact of the generic type that the at least two frame parts for the at least two resilient clamping elements are spaced apart from one another with an intermediate space between two adjacent lateral connecting pieces of adjacent frame parts.

As a result of the spacing between two adjacent lateral connecting pieces of adjacent frame parts, a free space is created in which it is possible to arrange preferably an actuating element, such as for example an actuating lever that is arranged in such a manner as to be able to pivot in a housing, which is embodied from an insulating material, and/or to arrange in said free space a housing wall. It is achieved in this manner that, whilst maintaining the required air paths and leakage paths, it is possible to achieve a very compact connecting clamp in the case of a very compact design of a resilient clamping contact.

In a preferred embodiment, the frame parts are formed as one piece with the current rail. For this purpose, conductor feedthrough openings are stamped out from a current rail metal plate in order to form lateral connecting pieces and a transverse connecting piece and prior to or following the step of stamping out said conductor feedthrough openings the lateral connecting pieces together with the transverse connecting piece that connects said lateral connecting pieces, in other words the frame parts, are bent away at an acute or obtuse angle from a clamping contact surface of the current rail. The angle between the current rail plane on which the clamping site is formed and the frame parts preferably amounts to approx. 60 to 120 degrees.

However, an embodiment is also feasible in which the frame parts are formed on a frame element that is separate from the current rail, wherein the frame element is latched into the current rail. The frame element is retained on the current rail as a result of the force of the resilient clamping elements that act between the transverse connecting piece and the frame parts of the frame element and the current rail, in that the frame element preferably engages under the current rail. For this purpose, retaining elements can be provided in the form of retaining protrusions on the current rail and said retaining protrusions are engaged from below by transverse connecting pieces of the frame element. However, it is also feasible that the current rail comprises latching openings or latching recesses into which latching fingers of the frame element latch in order to connect (in a releasable manner) the frame element to the current rail.

In order to form a clamping site for an electrical conductor, the clamping section of a resilient clamping element is preferably bent away or bent down in the direction towards the current rail, said section adjoining the resilient bend. In so doing, an electrical conductor is reliably clamped by means of the resilient clamping element and it is simultaneously ensured that the electrical conductor can be connected to the clamping site without prior actuation of the resilient clamping element.

Furthermore, it is advantageous if the clamping section has a narrower width than the remaining section of the clamping limb. This is particularly advantageous because it is possible using an actuating element to open as an actuating section the at least one region of the section of the clamping limb that is wider in relation to the clamping section, said region protruding laterally relative to the clamping section, in order to open a clamping site for an electrical conductor, said clamping site being formed between the clamping section of the resilient clamping element and the current rail; said actuating element cooperates with the actuating section and protrudes into the intermediate space between two frame parts.

BREIF DESCRIPTION OF THE DRAWINGS

Figure 2:
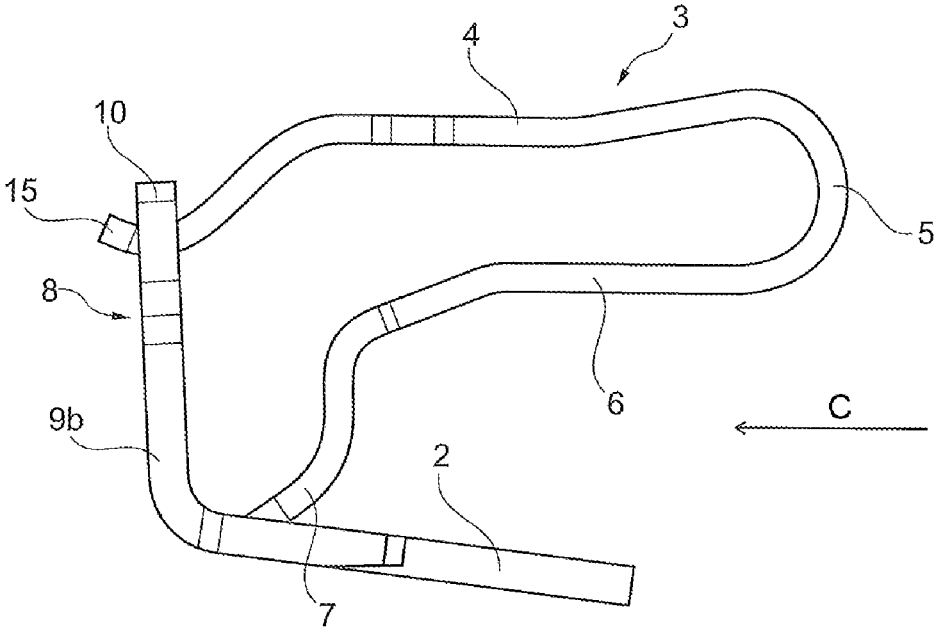
Figure 3:
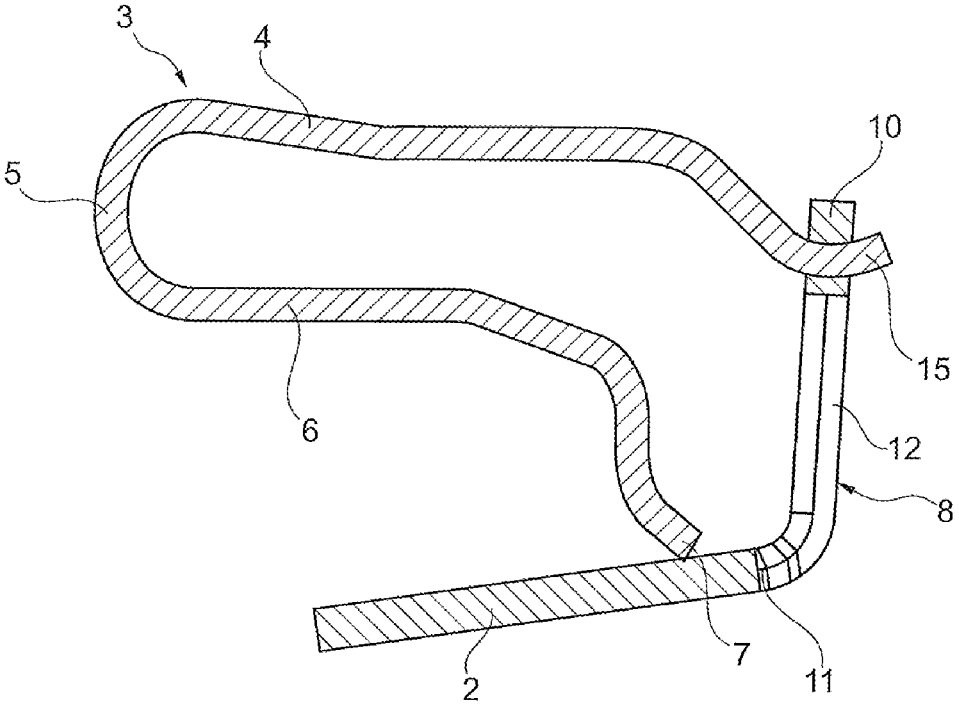
Figure 4:
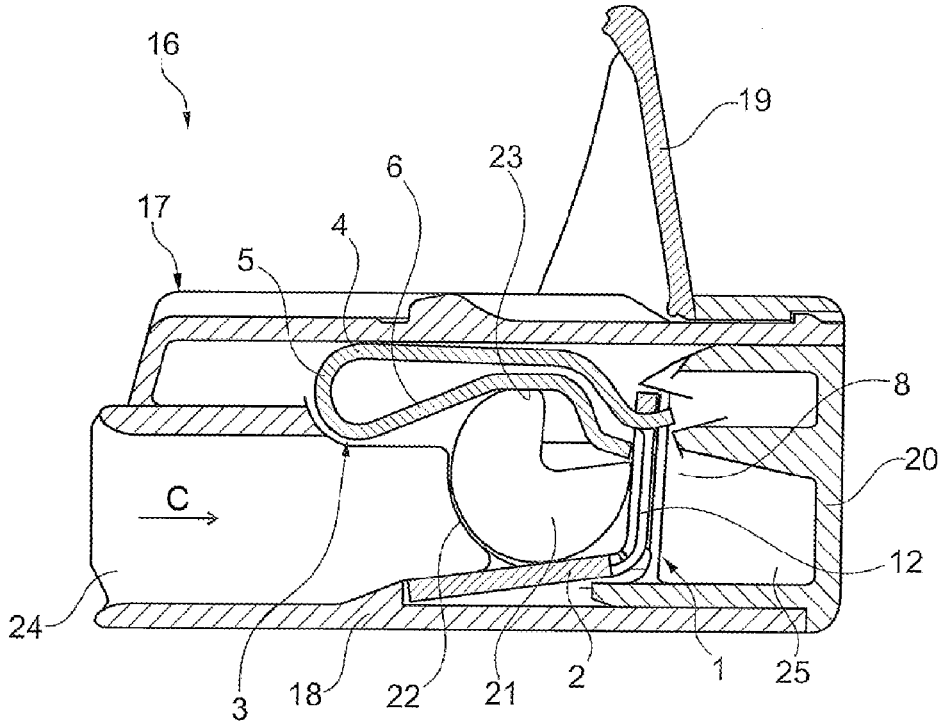
Figure 5:
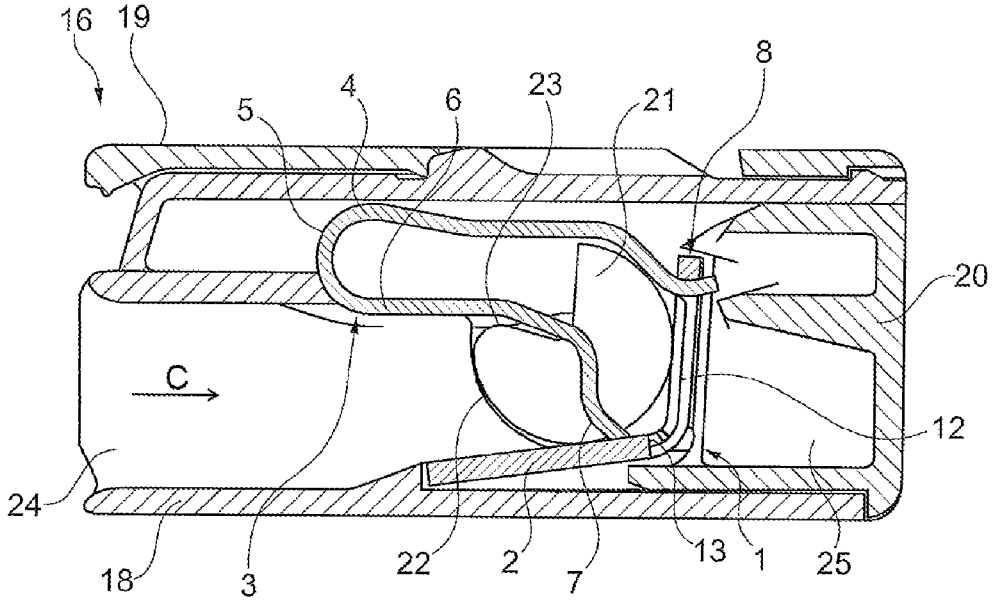
Figure 6:
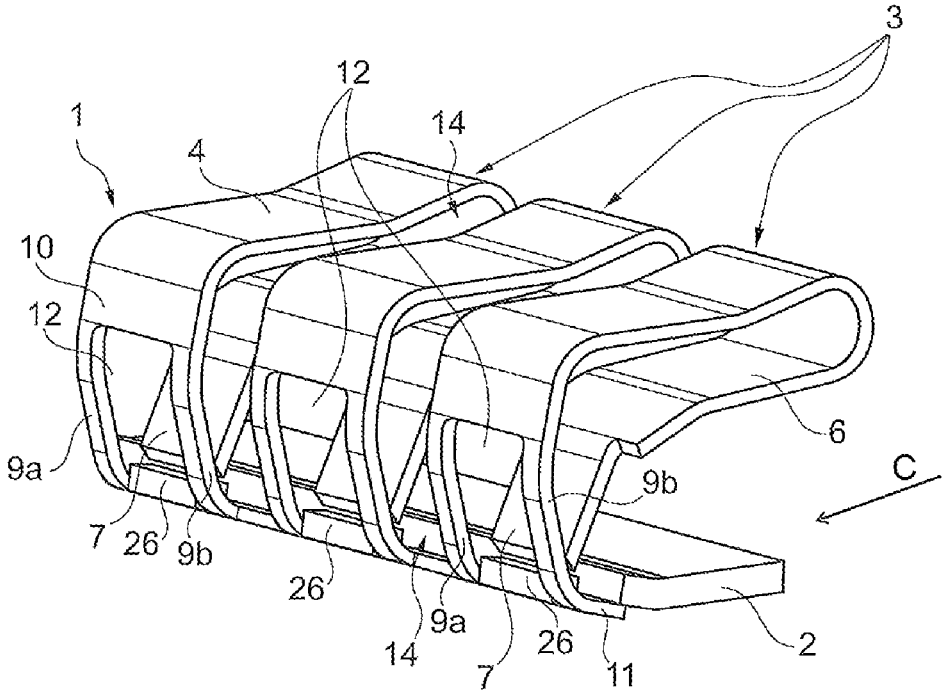
Figure 7:
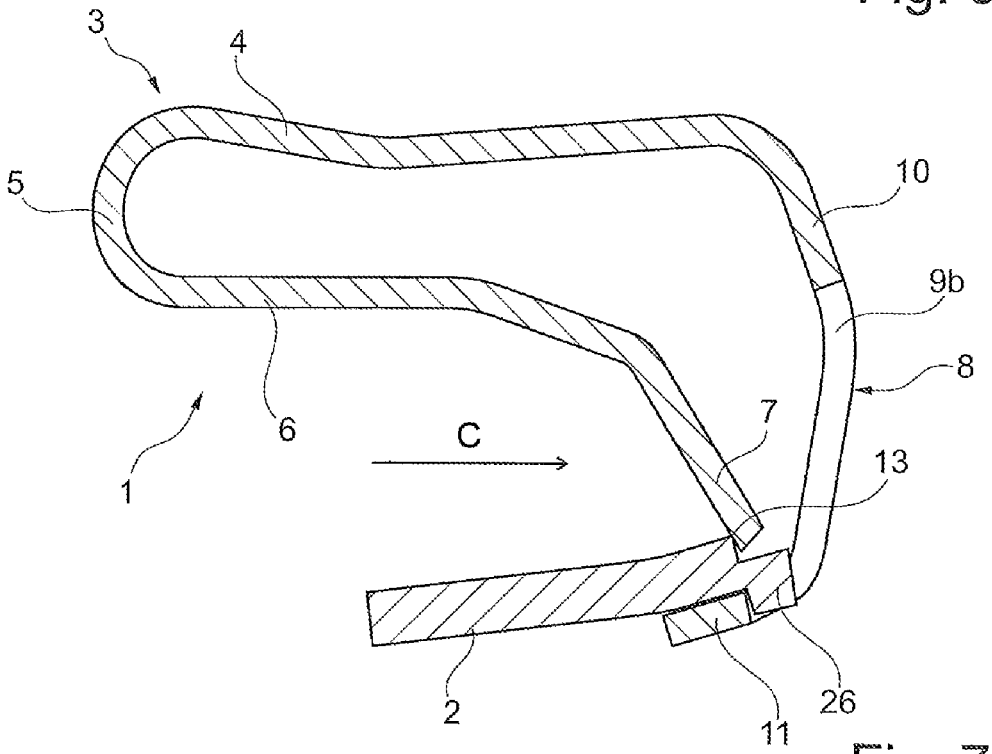
Figure 8:
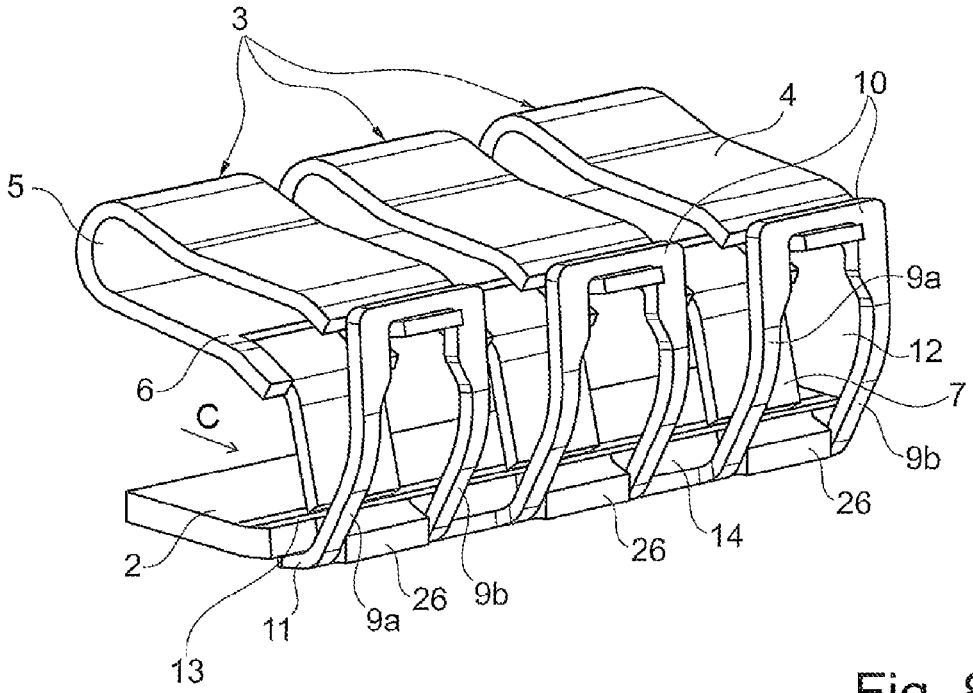
Figure 9:
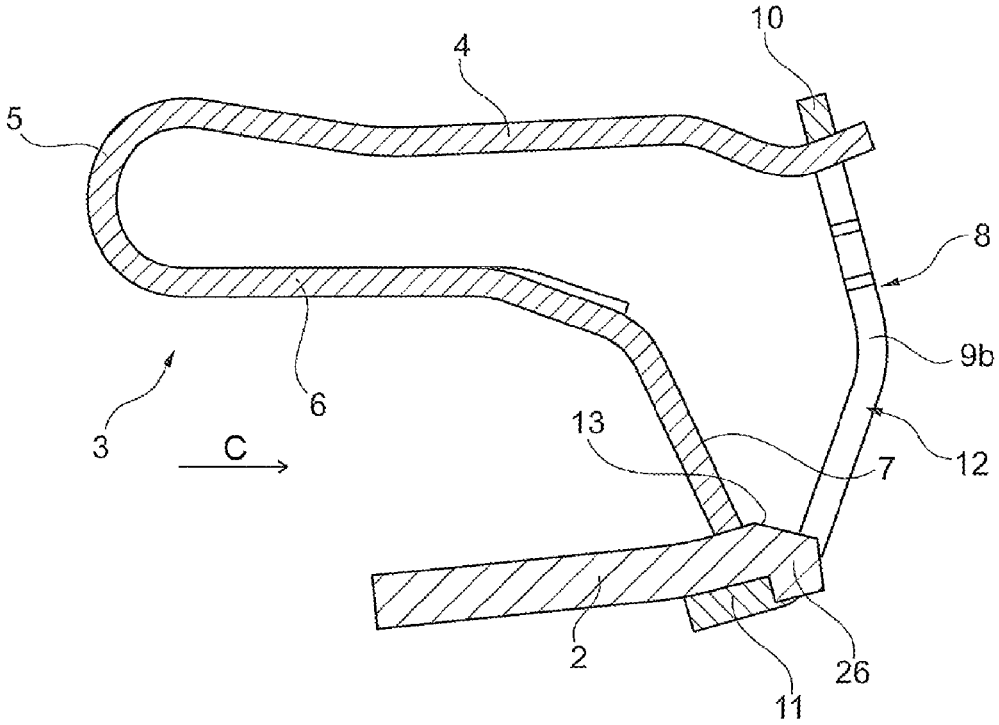

The invention is further explained hereinunder with reference to an exemplary embodiment and the attached drawings, in which:

FIG. 1—illustrates a perspective view of a first embodiment of a resilient clamping contact having a current rail and three resilient clamping elements that are arranged adjacent to one another;

FIG. 2—illustrates a side view of the resilient clamping contact from FIG. 1;

FIG. 3—illustrates a side sectional view of the resilient clamping contact from FIG. 1;

FIG. 4—illustrates a side sectional view through a connecting clamp having a housing that is embodied from an insulating material and is in this case an actuating lever for an allocated resilient clamping element, and said connecting clamp having a resilient clamping contact from FIG. 1 that is installed in the housing that is embodied from an insulating material, showing the actuating lever in the open position FIG. 5—illustrates a side sectional view through the connecting clamp from FIG. 4 with the actuating lever in the closed position;

FIG. 6—illustrates a perspective view of a second embodiment of a resilient clamping contact;

FIG. 7—illustrates a side sectional view through the resilient clamping contact from FIG. 6;

FIG. 8—illustrates a perspective view of a third embodiment of a resilient clamping contact;

FIG. 9—illustrates a side sectional view through the resilient clamping contact from FIG. 8.

DETAILED DESCRIPTION OF THE INVENTION

FIG. 1 illustrates a perspective view of a first embodiment of a resilient clamping contact 1 that is formed essentially by a current rail 2 and, for example as illustrated, three multiple resilient clamping elements 3. The current rail 2 is embodied from a material that has good electrically conductive characteristics, such as for example a copper metal sheet. Said current rail extends in a transverse manner with respect to the direction in which the resilient clamping elements 3 extend and in the direction in which the multiple resilient clamping elements 3 are arranged in a row. It is possible in this manner for the electrical conductor that is clamped by means of a resilient clamping element 3 at a clamping site on the current rail 2 to be connected in an electrically conductive manner to a further electrical conductor that is clamped to another resilient clamping element 3 of the resilient clamping contact 1.

The resilient clamping elements 3 have in each case a clamping limb 4, a resilient bend 5 that is connected to the contacting limb 4 and a clamping limb 6 that is connected to the resilient bend 5. The clamping limbs 6 have in each case a clamping section 7 at the free end and a clamping edge is formed on said clamping section. Using the current rail 2, frame parts 8 are formed that are allocated for each resilient clamping element 3 and that each have two lateral connecting pieces 9*a*, 9*b*, which are spaced apart from one another, and an upper transverse connecting piece 10 that connects the lateral connecting pieces 9*a*, 9*b* one to the other at the free end. The current rail 2 that extends in a transverse manner forms a further lower connecting piece 11 that lies opposite the upper connecting piece 10. The lateral connecting pieces 9*a*, 9*b* and the mutually opposite transverse connecting pieces 10, 11 form a conductor feedthrough opening 12 for feeding through an electrical conductor that is clamped to the clamping edge of the clamping section 7 of the allocated resilient clamping element 3 and the contacting edge 13 that is formed on the lower transverse connecting piece 11 of the current rail 2. The clamping edge of the clamping section 7 of the resilient clamping element 3 and the contacting edge 13 of the current rail 2 thus form a clamping site for the electrical conductor that is to be clamped.

It is evident that the frame parts 8 for the resilient clamping elements 3 that are arranged adjacent to one another whilst forming an intermediate space 14 between adjacent frame parts 8 are spaced apart from one another. The adjacent lateral connecting pieces 9*a*, 9*b* of the adjacent frame parts 8 are spaced apart from one another. A section of an actuating element (not illustrated) for at least one allocated resilient clamping element 3 can be accommodated in this intermediate space 14, so that the space between the resilient clamping elements 3 and in particular the space between the frame parts 8 can be used by the intermediate space 14 for receiving sections of an actuating lever. This renders it possible to produce a very compact connecting clamp.

It is further evident that the clamping section 7 of the resilient clamping element 3 has a narrower width than the adjacent other section of the clamping limb 6 and the resilient clamping element bend 5. This provides a region of the clamping limb 6 that protrudes laterally in a relative manner with respect to the clamping section 7 and an actuating contour of an actuating lever can influence said region of the clamping limb 6, wherein the actuating contour is arranged on a lateral wall section of an actuating lever that protrudes at least in the closed state into the intermediate space 14. The axis of rotation of this actuating lever (not illustrated) is then located below the clamping limb 6 and the resilient bend 5 in the intermediate space between the clamping limb 6 and the current rail 2.

It is further evident that the free end of the contacting limb 4 likewise has a narrower width than the section of the contacting limb 4 that adjoins the resilient element bend 5 and a narrower width than the resilient element bend 5. This reduced width of the contacting limb 4 is tailored to suit the width of the conductor feedthrough opening 12 of the frame part 8 in order to render it possible to latch the contacting limb 4 into the conductor feedthrough opening 2 in order to contact the upper transverse connecting piece 10.

FIG. 2 illustrates a side view of the resilient clamping contact 1 from FIG. 1. It is evident that the rear free end of the contacting limb 4 protrudes through the conductor feedthrough opening 12 of the frame part 8 and is latched into the frame part 8. It is further evident that the frame part 8 is formed as one piece in an integral manner with the current rail 2 from the same sheet metal part and is bent at an angle of approx. 90° to 120° from the plane of the current rail in the direction of the contacting limb 4 of the resilient clamping element 3, said plane being adjacent to the clamping edge of the resilient clamping element 3.

It is further evident that the clamping limb 6 is bent at an inner angle of approx. 70° to 120° in the direction of the plane of the current rail 2 and is arranged almost (+/−20°) perpendicularly with respect to this plane, said plane being the plane on which the clamping edge of the clamping section 7 is lying in the illustrated idle state. The clamping section 7 is bent back from this greatly bent section, which is arranged in a transverse manner with respect to the direction in which the conductor is inserted, towards the free end in order to form a clamping edge and said clamping section forms an acute angle with respect to the previously mentioned plane of the current rail 2. It is possible in this manner to prevent a direct clamping of a multi-strand electrical conductor that has been inserted in the direction in which the conductor is inserted C without previous actuation by displacing the clamping limb 6 upwards in the direction of the contacting limb 4. If a multi-wire electrical conductor is inserted directly in such a manner without actuating the clamping site in advance, the multiple strands of the electrical conductor can split open and said strands would then be located in the connection space in an uncontrolled manner.

FIG. 3 illustrates a side sectional view through the first embodiment of the resilient clamping contact from FIGS. 1 and 2. It is evident that the contacting limb 4 having a bent end section 15 is guided through the conductor feedthrough opening 12 and lies against the upper transverse connecting piece 10. The resilient clamping element 3 is thus latched in a stable position into the current rail 2. The opposite-lying end of the U-shaped bent resilient clamping element 3, in other words the clamping section 7 of the clamping limb 4 is bent in the direction of the section of the current rail 2, said section being adjacent to the frame parts 8 and extending in a transverse manner with respect to the number of resilient clamping elements 3, wherein the free end of the clamping section forms an acute angle with the transversely extending section of the current rail 2. On the other hand, an adjoining section of the clamping limb 6, said section being arranged in an almost transverse manner with respect to the direction in which the conductor is inserted C and the section of the current rail 2 forms an obtuse angle with the transversely extending section of the current rail 2 in order to prevent a multi-wire electrical conductor being inserted directly without prior actuation of the resilient clamping element 3.

FIG. 4 illustrates a cross-sectional view of a connecting clamp 16 having a housing that is embodied from an insulating material 17. The housing that is embodied from an insulating material 17 is designed in two parts and has a main housing part that is embodied from an insulating material 18 and is closed by means of a cover part 20 after an actuating lever 19 and the resilient clamping contact 1 have been applied. The main housing part 18 and the cover part 20 are latched one with the other in order in this manner to mount the actuating lever 19 with a pivot bearing section 21 in the housing that is embodied from an insulating material 17, said pivot bearing section having a segment-shaped periphery, on this segment-shaped periphery that has segment-shaped bearing contours 22 that are tailored to suit said segment-shaped periphery. The pivot bearing section 21 can also be mounted on the current rail 2.

It is evident that the pivot bearing section 21 comprises an actuating contour 23 in the form of a V-shaped section that merges into the outer periphery by way of a curved path. The clamping limb 6 of the allocated resilient clamping element 3 lies with a lateral region on this actuating contour 23 so that the clamping limb 6 in the illustrated open position of the actuating lever 9 is displaced away from that transversely extending section of the current rail 2.

It is then possible to insert an electrical conductor by way of a conductor insertion opening 24 that is provided in the housing that is embodied from an insulating material 17 and is open at the end face and issues into the connection space of the resilient clamping contact 1. Said electrical conductor is then inserted by way of the section of the current rail 2 through the conductor feedthrough opening 12 of the allocated frame part 8 of the resilient clamping contact 1, said section being arranged in an inclined manner and extending in a transverse manner with respect to the resilient clamping elements 3. The free ends of an electrical conductor that are stripped of insulating material then pass into a conductor receiving pocket 25 that, when viewed in the direction in which the conductor is inserted C, in other words in the direction in which the conductor insertion opening 24 extends, lie downstream of the conductor feedthrough opening 12 of the frame part 8.

FIG. 5 illustrates the connecting clamp 16 from FIG. 4 in the closed position. The actuating lever 19 is folded downwards in the direction of the housing that is embodied from an insulating material 17. The actuating contour 23 has rotated as a result of the pivot bearing section 21 pivoting by approx. 90°. It is rendered possible that the clamping limb 6 is displaced away from the contacting limb 4 downwards in the direction of the current rail 2 as a result of the force of the resilient clamping element 3. In the illustrated closed final position, the clamping limb 6 is no longer lying on the actuating section 23 so that the resilient clamping element 3 can move unimpaired by means the actuating lever 19. Consequently, an electrical conductor (not illustrated) that is inserted into the conductor insertion opening 24 is fixedly clamped in an electrically conductive and mechanical manner as a result of the force of the resilient clamping element 3 by means of the clamping edge on the free clamping section 7 and the contact edge 13 on the current rail 2, so that an electrical current can be directed by way of the electrical conductor and the current rail 2 to an adjacent clamping contact.

FIG. 6 illustrates a perspective view of a second embodiment of a resilient clamping contact 1. A current rail 2 also extends in this figure in a transverse manner with respect to the direction in which the multiple resilient clamping elements 3 are arranged in a row. A retaining protrusion 26 for each resilient clamping element 3 protrudes from the current rail 2 from the lateral edge of the current rail 2 in the direction in which the conductor is inserted C, in other words in the direction extending from the contacting limb 4 and the clamping limb 6 of the resilient clamping elements 3.

In the case of this embodiment, a clamping site is provided for clamping an electrical conductor by means of a clamping edge at the free end of the clamping section 7 of the resilient clamping element 3 and a contact edge 13 is provided on the allocated retaining protrusion 26. An electrical conductor that is to be clamped is consequently pushed as a result of the force of the resilient clamping element 3 by means of the clamping edge onto the clamping section 7 of the resilient clamping element 3 against the contact edge 13 on the opposite-lying retaining protrusion 26. In this manner, the force of the resilient clamping element 3 is concentrated on a defined reduced contact region and thus the surface pressure is optimized.

In the illustrated exemplary embodiment, the frame parts 8 are now formed as one piece in an integral manner with the allocated resilient clamping element 3. The frame parts 8 are formed as an extension of the contacting limb 4 and are bent from the contacting limb 4 in the direction of the opposite-lying transversely extending section of the current rail 2. The frame parts 8 have in turn lateral connecting pieces 9*a*, 9*b* and at the free end a transverse connecting piece 11 that connects the lateral connecting pieces 9*a*, 9*b* one to the other and engages under the current rail 2. The resilient clamping element 3 is latched into the current rail 2 with the aid of this transverse connecting piece 11 and as a result of the force of the resilient clamping element is held by way of the clamping limb 6 against the current rail 2.

As a result of the frame parts 8 merging into the contacting limb 4 that adjoins thereto, an upper transverse connecting piece 10 is provided for connecting the frame parts 8 so that the transverse connecting pieces 10, 11 and the lateral connecting pieces 9*a*, 9*b* form a conductor feedthrough opening 12 for feeding through an electrical conductor.

FIG. 7 illustrates a side cross-sectional view through the resilient clamping contact 1 from FIG. 6. It is evident that the transverse connecting piece 11 is folded over or bent at the free end of the frame part 8 and lies below the transversely extending section of the current rail 2. The retaining protrusion 26 is displaced downwards out of the plane of the current rail 2, for example by means of pressing, in order to form a stop for the lower transverse connecting piece 11. In this manner, the resilient clamping element 3 is locked on the current rail 2. As a result of displacing the retaining protrusion 26 in the downwards direction, a contacting edge 13 is created on the upper face of the current rail 2 for clamping an electrical conductor and the clamping force of the resilient clamping element 3 is concentrated thereon. It is evident that the clamping section 7 is inserted at the free end of the clamping limb 6 of the resilient clamping element 3 into the free space that is created by displacing the retaining protrusion 26 in the downwards direction and that said clamping section is lying against the end face 2 of the current rail 2 or the clamping edge 13. Consequently, a self-supporting system is created from the current rail 2 and the resilient clamping element 3 and said system can be installed preassembled in this manner in the housing 17 of a connecting clamp 16, said housing being embodied from an insulating material.

FIG. 8 illustrates a perspective view and FIG. 9 illustrates a side cross-sectional view of a third embodiment of a resilient clamping contact 1. Multiple resilient clamping elements 3 are also illustrated arranged in turn adjacent to one another in a row and latched into a current rail 2. In the case of this embodiment, frame parts 8 are provided separately from the current rail 2 and the resilient clamping element 3 and said frame parts are preferably formed from a sheet metal material. The task of the current rail 2 can be compared to the first embodiment. The retaining protrusion 26 is also displaced in the downwards direction with respect to the lower face of the current rail 2 in order to form a stop for the lower transverse connecting piece 11 of the frame part 8. However, in contrast to the second embodiment, a free space is not provided with a shoulder for forming a clamping edge 13. On the contrary, the current rail extends from the upper plane in an inclined manner so that a clamping edge 13 is formed in the transition between the upper plane of the current rail 2 and the end that terminates in an inclined manner. However, it is also feasible to use the current rail 2 from the second exemplary embodiment in the case of the present solution.

In the third embodiment, the first embodiment and second embodiment are combined in such a manner that with the aid of the separate frame parts 8 the contacting limb 4 of the allocated resilient clamping element 3 is latched into the upper transverse connecting piece 10 and with the aid of the retaining protrusion 26 the current rail 2 is latched into the lower transverse connecting piece 11. The frame parts 8 also comprise in this case two lateral connecting pieces 9*a*, 9*b* that are spaced apart from one another and on the two opposite-lying ends comprise transverse connecting pieces 10, 11 that connect the lateral connecting pieces 9*a*, 9*b* one to the other in order in this manner to create a circumferentially closed frame with a conductor feedthrough opening 12 that is formed therebetween.

It is provided in the case of all three embodiments that the frame parts 8 are arranged spaced apart from one another on the current rail 2 with an intermediate space 14. It is irrelevant whether the frame parts are formed as one piece in an integral manner with the current rail 2 or with an allocated resilient clamping element 3 or as a component that is separate from the current rail 2 and the resilient clamping elements 3.

The resilient clamping contact 1 and a connecting clamp 16 that is equipped with a resilient clamping contact 1 of this type can also be produced in a two-row manner. Two parallel conductor connecting planes that are spaced apart from one another are provided, in that frame parts 8 extend towards one another in opposite directions. It is possible to provide for this purpose a double-layer current rail 2 that have integrally formed frame parts 8 that extend in the opposite direction. However, separate frame parts can also be accommodated in a space between the double-layer current rail. It is however also feasible that conductor connectors are arranged in a row on a current rail 2 and adjacent to one another with alternating frame parts 8 that are arranged in the opposite direction. A two-row connecting clamp 16 can also be created by virtue of the fact that at least one resilient clamping element 3 that is bent by 180° with respect to another is provided in each case above and below the current rail and frame parts 8 are also provided on mutually opposite outer edges of the current rail 2, said frame parts being arranged on the one hand in the space above and on the other hand in the space below the current rail 2.

The invention claimed is:

1. A resilient clamping contact for contacting electrical conductors, comprising:

a current rail including at least two frame parts that extend away from the current rail, each frame part comprising two lateral connecting pieces that are spaced apart from one another and a transverse connecting piece that connects the two lateral connecting pieces one to the other, and a conductor feedthrough opening that is formed by the lateral connecting pieces and the transverse connecting piece;

at least two resilient clamping elements each including a contacting limb, a resilient bend that adjoins the contacting limb, and a clamping limb that adjoins the resilient bend, the clamping limb including a clamping section at a free end of the clamping limb, wherein a clamping site for clamping an electrical conductor is formed between the respective clamping section and the current rail, wherein a resilient clamping element is fastened to the current rail via a contact of the contacting limb and/or a retaining element of the current rail to a transverse connecting piece in a manner that the clamping section acts in the direction of the current rail under the influence of the resilient force of the resilient clamping element, and wherein the at least two frame parts for the at least two resilient clamping elements are arranged spaced apart from one another with an intermediate space between two spaced apart lateral connecting pieces of adjacent frame parts.

2. The resilient clamping contact as claimed in claim 1, wherein the at least two frame parts are formed as one piece with the current rail.

3. The resilient clamping contact as claimed in claim 1, wherein the at least two frame parts are embodied as at least one frame element that is separate from the current rail, the separate at least one frame element latched into the current rail.

4. The resilient clamping contact as claimed in claim 3, wherein the current rail comprises retaining protrusions as a retaining element for the at least two frame parts, wach of the at least two frame parts having a transverse connecting piece configured to engage under the retaining protrusions of the current rail.

5. The resilient clamping contact as claimed in claim 3, wherein the current rail comprises latching openings or latching recesses and that the at least two frame parts each comprises latching fingers that latch into allocated latching openings or latching recesses.

6. The resilient clamping contact as claimed in claim 1, wherein the clamping section is bent away or down from a section of the clamping limb in a direction towards the current rail, said section of the clamping limb adjoining the resilient bend.

7. The resilient clamping contact as claimed in claim 1, wherein the clamping section comprises a narrower width than a remaining section of the clamping limb.

8. The resilient clamping contact as claimed in claim 7, wherein at least one region of the section of the clamping limb that is wider in relation to the clamping section comprises an actuating section, said at least one region protruding laterally relative to the clamping section, and wherein a clamping site for an electrical conductor is openable via an actuating element that cooperates with the actuating section, said clamping site being formed between the clamping section, the resilient clamping element and the current rail.

9. A connecting clamp for electrical conductors, comprising:

a housing embodied from an insulating material;

at least one resilient clamping contact as claimed in claim 1; and at least one actuating element movably arranged in the housing embodied from an insulating material, wherein the at least one actuating element protrudes into an allocated intermediate space between two adjacent lateral connecting pieces of adjacent frame parts and comprises a contour for influencing at least one resilient clamping element in order to open a clamping site that is formed between the clamping section of the resilient clamping element and the current rail in order to clamp an electrical conductor.

* * * * *